US007648395B2

(12) United States Patent
Ma

(10) Patent No.: US 7,648,395 B2
(45) Date of Patent: Jan. 19, 2010

(54) ELECTRICAL CONNECTOR HAVING A SHIELDED ELEMENT WITH CONDUCTIVITY AND COMPRESSIBILITY

(75) Inventor: Wen-Qiang Ma, ShenZhen (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/217,208

(22) Filed: Jul. 1, 2008

(65) Prior Publication Data

US 2009/0017679 A1 Jan. 15, 2009

(30) Foreign Application Priority Data

Jul. 10, 2007 (CN) ..... 200720040636

(51) Int. Cl.
*H01R 13/648* (2006.01)

(52) U.S. Cl. ..... 439/607

(58) Field of Classification Search ..... 439/607, 439/71, 73, 330
See application file for complete search history.

(56) References Cited

U.S. PATENT DOCUMENTS 6,939,172 B2 * 9/2005 Lu ..... 439/607
7,223,125 B2 * 5/2007 Chen ..... 439/609
7,402,082 B2 * 7/2008 Zhang ..... 439/607
7,435,140 B2 * 10/2008 Wang ..... 439/607
7,467,974 B2 * 12/2008 Zhang ..... 439/607
2006/0063431 A1 * 3/2006 Yang ..... 439/607
2007/0238357 A1 10/2007 Wang
2008/0045085 A1 2/2008 Zhang
2008/0050941 A1 2/2008 Zhang

* cited by examiner

*Primary Examiner*—Javaid Nasri
(74) *Attorney, Agent, or Firm*—Ming Chieh Chang; Wei Te Chung; Andrew C. Cheng

(57) ABSTRACT

An electrical connector for interconnecting a camera module with a printed circuit board comprises a shield housing including a base wall and side wall.

Wherein at least a grounding finger is formed on the side wall and extends from the inner surface of the side wall to the opposite wall for contacting with the periphery of the camera module. And a shield element, which can be compress and conductive, is attached to the bottom surface of the housing. Therefore, when the electrical connector is assembled into a chamber formed on the mobile phone for accommodating the electrical connector, the shield element can be compressed between the housing and the inner wall of the chamber, thus, the electricity from the camera module can be transmitted to the mobile phone via the shield element and the electrical connector is not interfered by the other electric equipment.

2 Claims, 5 Drawing Sheets

ELECTRICAL CONNECTOR HAVING A SHIELDED ELEMENT WITH CONDUCTIVITY AND COMPRESSIBILITY

BACKGROUND OF THE INVENTION

1. Field of the Invention

The present invention relates to an electrical connector, and more particularly to an electrical connector for interconnecting an electronic module such as a camera module for use with a cellular phone or the like to an electrical member such as a printed circuit board. A shielded element which has conductivity and compressibility is formed on out surface of the connector to provide a well shielding function on the electrical connector.

2. Description of the Related Art

Conventionally, electronic modules such as a camera module for use with a cellular phone has to be securely maintained in electrical connection with an electronic member such as a printed circuit board. Therefore, a camera socket is dimensioned to securely receive a camera module therein. Consequently, the camera module is electrically connected with the printed circuit board via the shielded connector.

In order to comply with a miniaturization trend of electrical connectors, a flexible printed circuit board is used in said electrical connector to reduce the height of the electrical connector and provide a reliable electric path between a camera module and a printed circuit board.

U.S. Pub No. 2008/0045085, published on Feb. 21, 2008, discloses an electrical connector for interconnecting a camera module and a printed circuit board via a flexible printed circuit board. Said electrical connector includes a shielded shell and a supporting member attached to the shielded shell. The shielded shell includes a base wall and four side walls commonly defining a receiving space for accommodating a camera module, each side wall extending upwardly from an edge portion of the base wall. Said base wall defines a top surface for attached to the supporting member and a bottom surface opposite to the top surface and adapted for connecting with the printed circuit board. Said side walls comprises a pair of first side walls opposite to each other and a pair of second side walls opposite to each other, wherein each of the first side walls defining a locking finger extending from the inner surface thereof to opposite side wall so as to hold the camera module, each of the second side walls defining a grounding finger extending from the inner surface thereof to the opposite side wall adapted for connecting with the periphery of the camera module. The supporting member includes a main portion attached to the top surface of the shielded shell and a plurality of elastic arms extending from the opposite side edges to outside. When the camera module is inserted into the receiving space of the shielded shell, the elastic arms of the supporting member moves downwardly as the movement of the camera module, and the camera module located into the shielded shell by the elasticity of the supporting member and an electric path between the camera module and printed circuit board is provided.

It is well know that EMI (electro magnetic interference) is a key factor in an electrical connector. If an electrical connector has not a function of preventing the EMI, transmission of the signals in mobile phone is interfered by the other electrical equipment. In order to solve said problem, the electrical connector disclosed by U.S. Pub No. 2008/0045085 includes a shielded shell having at least a grounding finger, therefore, when the electrical connector is assembled on the printed circuit board, the signal of the camera module is transmitted to the printed circuit via the grounding finger against the camera module, therefore, the EMI function has reached. However, it is usually possible that a gap is formed between the shielded connector and the print circuit board, at this moment, the EMI function can be interfered. Similarly, if the elasticity of the grounding finger is poor, it is possible that the grounding finger does not well connect with the camera module, accordingly, the EMI function can also be interfered.

Thus, there is a need to provide an improved electrical connector to overcome the above-mentioned problems.

BRIEF SUMMARY OF THE INVENTION

It is an object of the present invention to provide an electrical connector having a shielded element with conductivity and compressibility so as to provides a reliable EMI function.

In order to achieve the objective above, an electrical connector in accordance with an embodiment of the present invention at least includes a housing, and the housing at least has a base wall and side walls commonly defined a receiving space to accommodate a camera module. A shielding element with conductivity and compressibility is attached to the out surface of the housing. Thus, when the electrical connector is put into an acceptor formed in the mobile phone to accommodate the electrical connector, the shielding element is compressed, therefore the out surface of the housing can firmly contact with the inner surface of the acceptor and the electrical connector provides a well function to prevent the broadcast of the EMI.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

An electrical connector according to the present invention is applicable to an electronic apparatus such as digital cameras, PDAs (Personal Digital Assistants), PCs (Personal Computers), mobile phones or the like. In the embodiment illustrated in FIGS. 1-5, the electrical connector is used in a mobile handset (not shown) for transferring the signal of the camera module to a printed circuit board via a flexible printed circuit board.

Figure 1:
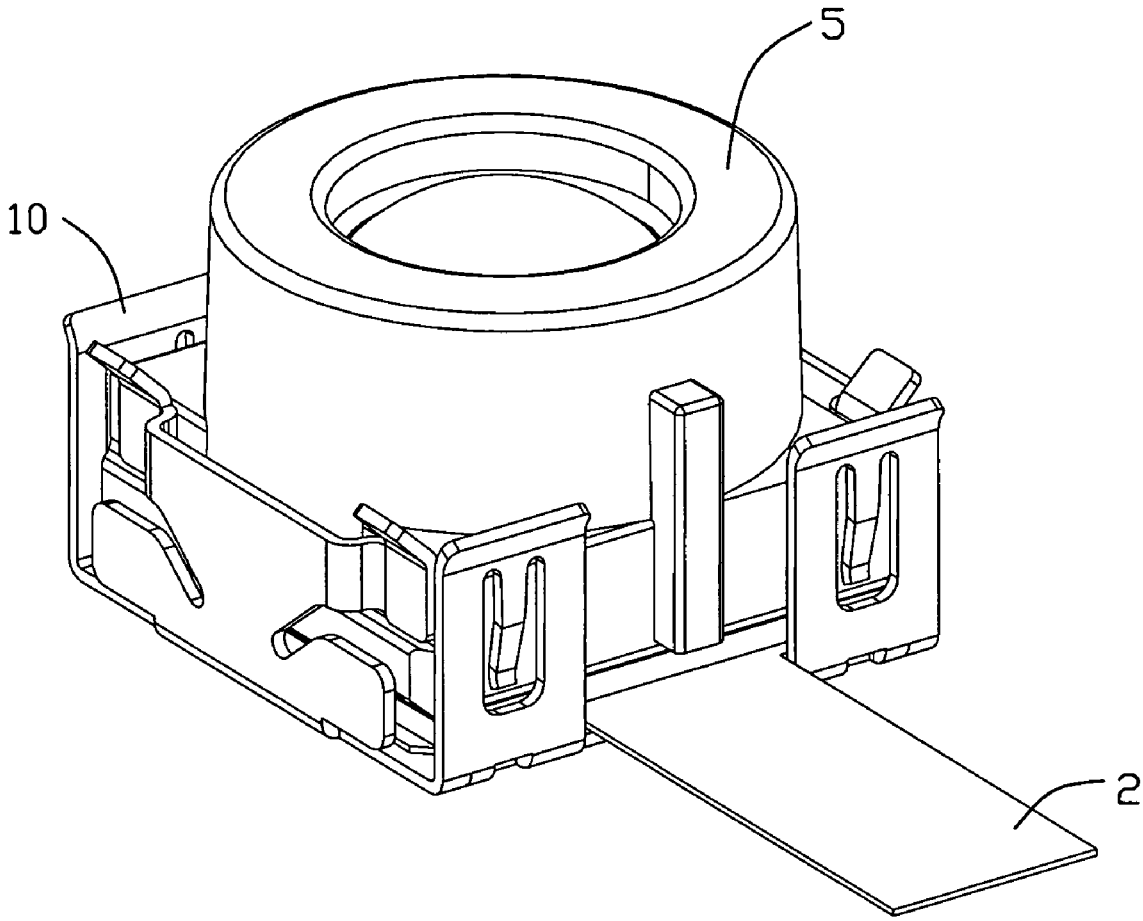
FIG. 1 is a perspective view of an electrical connector without a shielding element according to the embodiment of the present invention.
Figure 2:
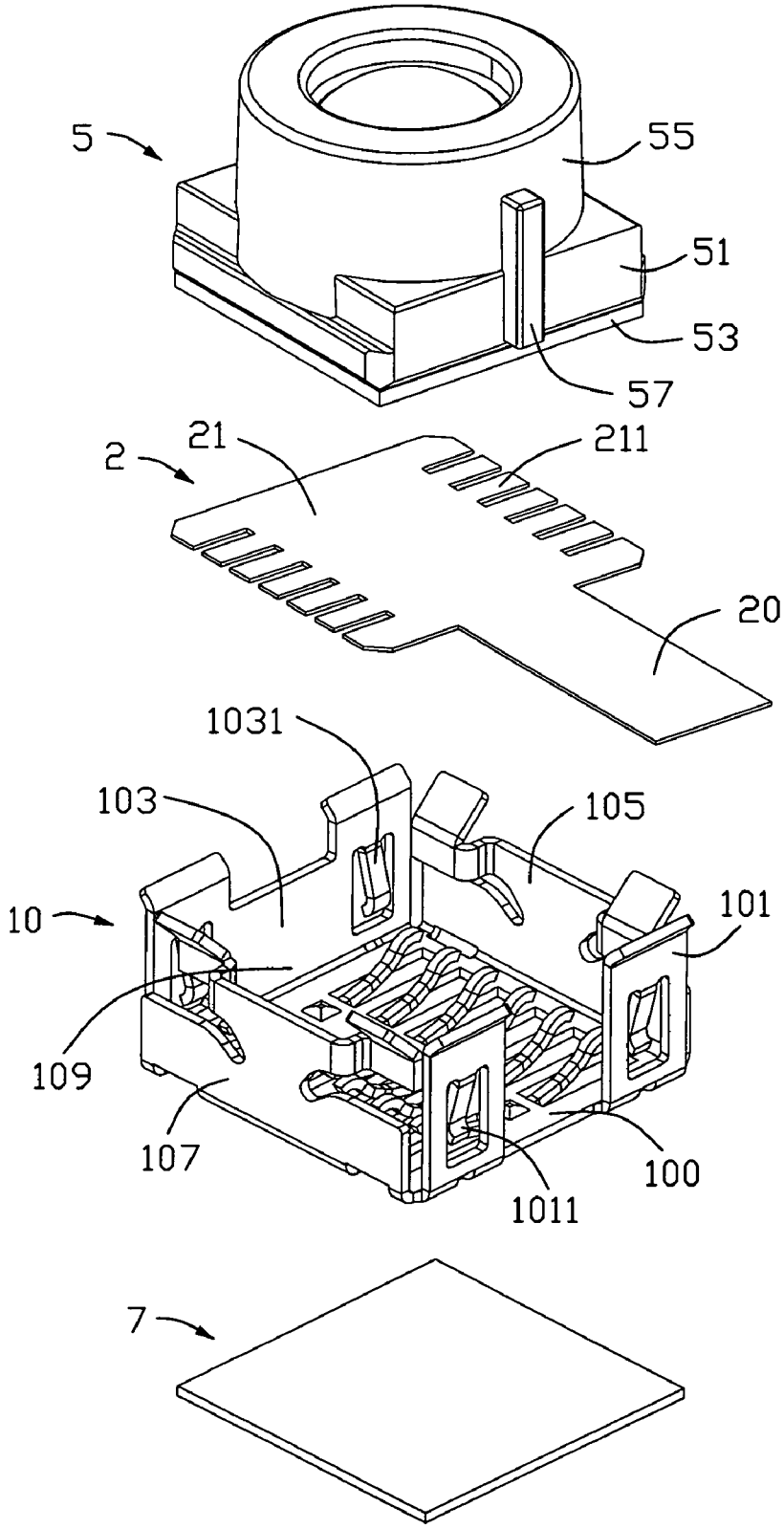
FIG. 2 is an exploded view of an electrical connector with a shielding element according to the embodiment of the present invention.
Figure 3:
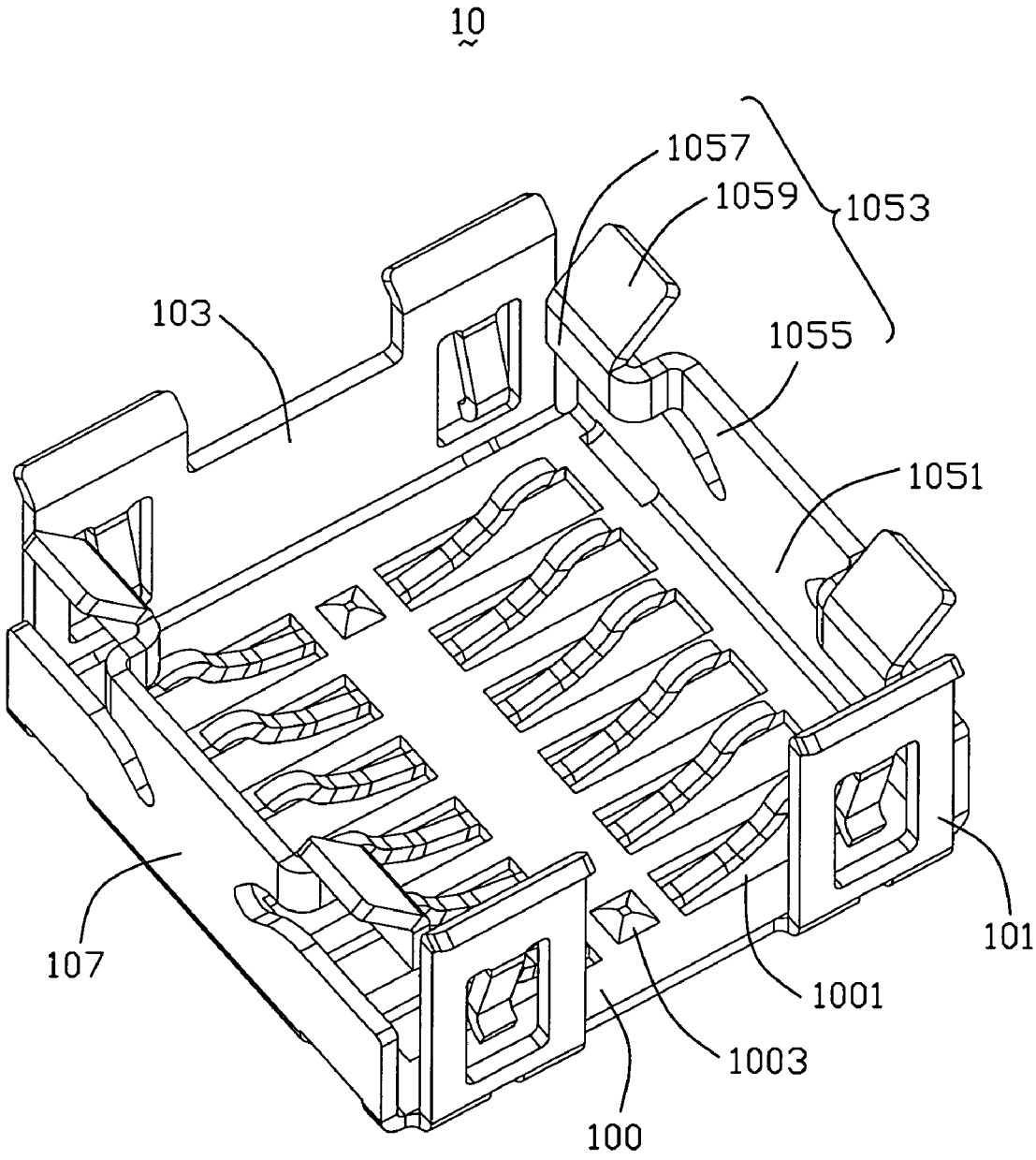
FIG. 3 is perspective view of the housing of the electrical connector in FIG. 2.
Figure 4:
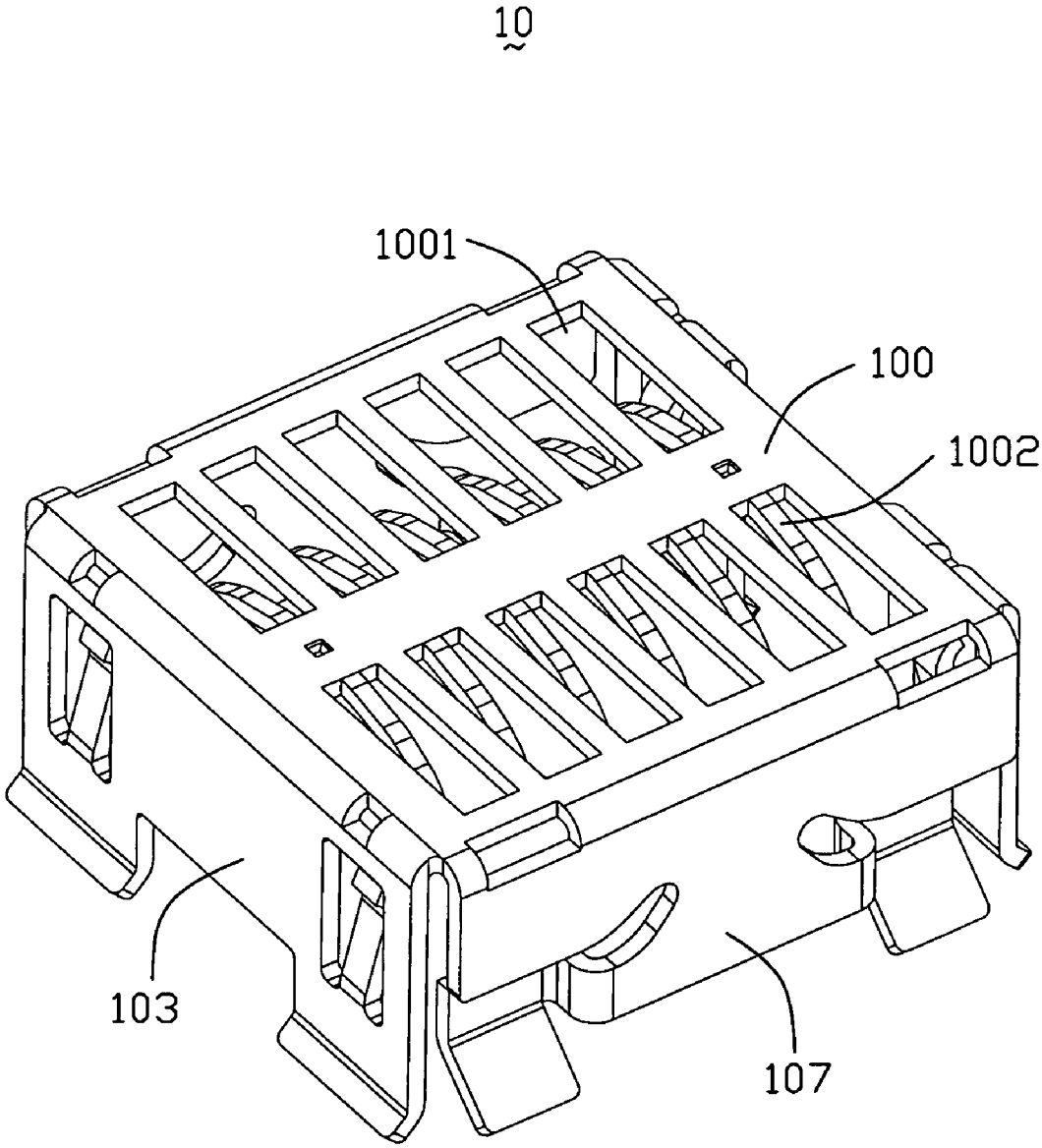
FIG. 4 is a bottom plan view of the FIG. 3.

FIG. 1 is a perspective view of the electrical connector according to the embodiment of this invention in order to receive a camera module via a flexible printed circuit board. In the figures, the reference numeral 10 denotes a housing made of a metal material. The reference numeral 2 denotes a flexible printed circuit board, the reference numeral 5 denotes a camera module, and the reference numeral 7 denotes a shielding element.

The housing 10 is made of metal material and configured by front wall 103, rear wall 101, left wall 107, right wall 105 and a base wall 100 cooperatively defining a receiving space 109. Each front wall 103, rear wall 101, left wall 107 and right wall 105 extends upwardly from the peripheral of the base wall 101 and the adjacent walls of the said walls did not connect each other so as to improve the elastic property of the housing 10 and retain the camera module 5 steadily.

Each of the front and back wall 103, 101 defines a pair of grounding finger 1031, 1011 extending from the inner surface thereof to the opposite walls for connecting with the peripheral wall of the camera module 5 and the end of the grounding finger 1031, 1011 smoothly curved inwardly in order to prevent the camera module 5 from being scraped. Further more, the rear wall 101 defines a window (not shown) passing through the top thereof to the down so as to provide a path for the flexible printed circuit board 2 passing through.

The left and right wall 107, 105 has the same structure, herein we take the right wall 105 to introduce. Right wall 105 includes a fixed section 1051 and an elastic section 1053. The fixed section 1051 connects to the base wall 100 and extending upwardly and the elastic section 1053 extends upwardly from the middle portion of the up edge of the fixed section 1051 and is an encircled configuration. Said elastic section 1053 comprises a board portion 1055 connected with the fixed section 1051 and a pair of holding portions 1057, each holding portion 1057 extending inwardly from a side end of the board portion 1055 to opposite wall. The holding portion 1057 and the board portion 1055 are parallel to each other and they are connected via a connected portion (not shown), wherein a slant section 1059 is formed on the top edge of the holding portion 1057 and extends upwardly away from the opposite wall so as to lead the inserting of the camera module 5.

A plurality of grooves 1001 are formed on the base wall 100 and penetrate through the base wall 100. Said grooves 1001 arranges as two rows and adjacent to the left and right walls 107, 105 along a leftwall-to-rightwall direction. Each groove 1001 defines a spring finger 1002 which extending toward the left or right wall from an edge of the groove 1001, wherein each spring finger 1002 has an engaging portion (not shown) above the groove 1001 so as to contact with the bottom face of the flexible printed circuit board 2. A flat portion (not shown) disposed between the two row grooves 1001 defines a pair of protrusions 1003 extending toward the receiving space 109, while said protrusions 1003 can connect to each other to form a strip. The top face of the protrusion 1003 or strip is little lower than the highest point of the engaging portion of the spring finger 1002.

Figure 5:
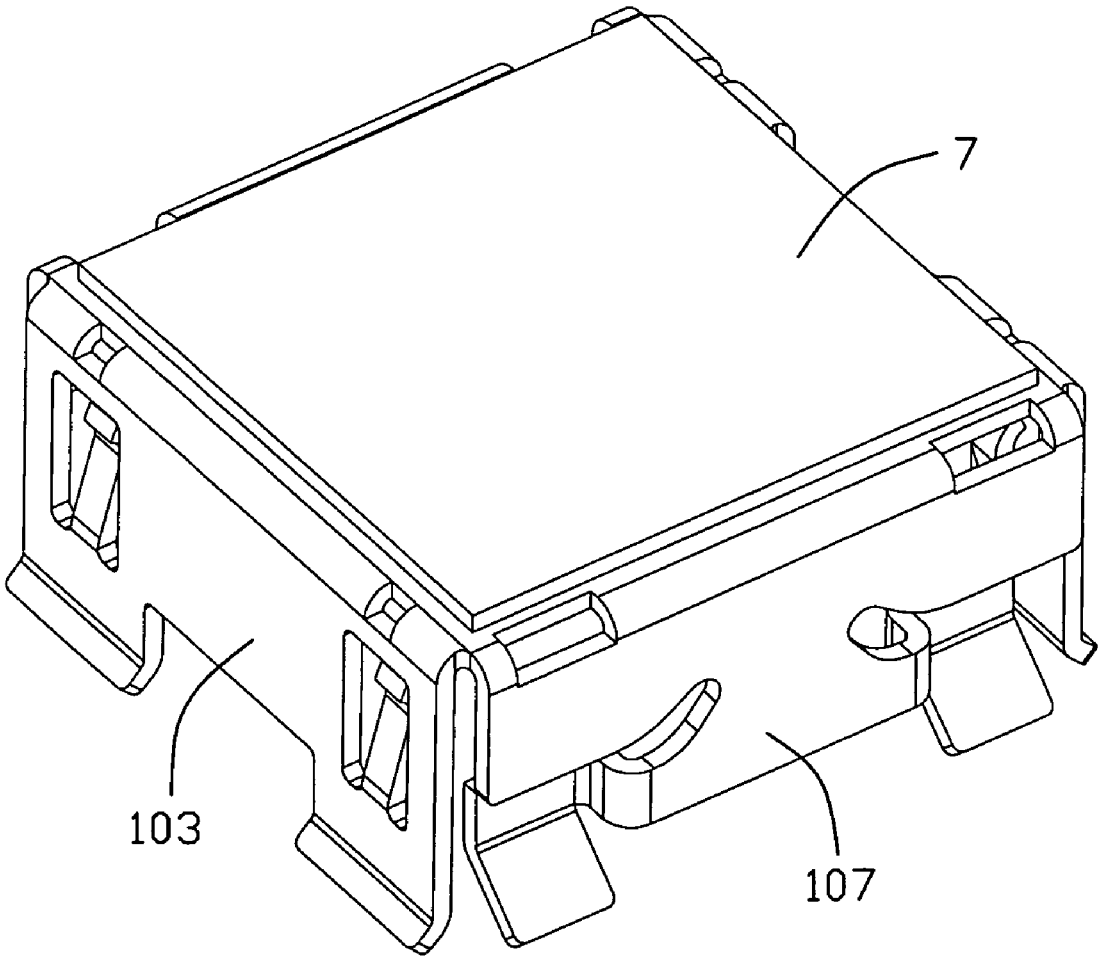
FIG. 5 is similar with FIG. 4, but the shielding element is attached onto a bottom face of the housing.

Please especially referring to the FIGS. 5-6, the flexible printed circuit board 2 disposed between the housing 10 and the camera module 5 and comprises a first section 21 received in the receiving space 109 of the housing 10 and a second section 20 extending beyond the receiving space 109 via the window of the housing 10. The first section 21 defines a plurality of conductive pads 211 corresponding to the engaging portion of the spring finger 1002. The conductive pads 211 separate to each other, therefore, each conductive pad 211 can contact to corresponding engaging portion of the spring finger 1002 and it is impossible to interfere to each other.

Additionally, the first section 21 has an equivalent dimension with the receiving space 109 of the housing 10 and the width of the second section 20 is smaller than that of first section 21 and equal to the width of the window of the housing 10 so as to prevent the flexible printed circuit board 2 from being pushed out from the receiving space 109.

The camera module 5 comprises a base portion 51 which configured as a rectangular, a column portion 55 disposed on a top surface of the base portion 51, and a bottom portion 53 a top surface of which contacts with a bottom surface of the base portion 51. A strip 57 is formed on one side surface of the base portion 51 and extends to the peripheral of the column portion 55 so as to prevent the camera module 5 mismatchable assembling into the receiving space 109 of the housing 10.

A shield element 7 is attached to a bottom face of the housing 10 and is made of conductive material and is compressive, in preferred embodiment, it is made of conductive foam. In other words, an element with well conductive is attached to the out surface of the foam. Therefore, the foam has well compressibility and the outer layer element has well conductivity, as a result, when the shield element 7 is attached to the housing 10 and the electrical connector is assembled to the mobile phone, said shield element 7 disposed between the mobile phone and electrical connector is compressed, therefore, the housing 10 can be well connected with the printed circuit board of the mobile phone and the electricity from the camera module 5 can be transmit to the printed circuit board.

When assembly, firstly, the flexible printed circuit board 2 and the camera module 5 is put into the receiving space 109 of the housing 10 in turn, with the first section 21 is received in the receiving space 109 and the second section 20 is passing out of the received space 109 through the window of the housing 10, the bottom face of each conductive pad 211 of the first section 21 contacting to corresponding engaging portion of the spring finger 1002, and the top face of the conductive pad 211 contacting to the bottom face of the camera module 5.

During the process of the camera module 5 assembling into the housing 10, the spring finger moves downwardly as the movement of the camera module, finally the camera module is holed in the housing via the elasticity of the spring finger 1002. when camera module is completely assembled into the housing, the holding portion of the side wall is against the out surface of the camera module, by which the camera module is fixed in a direction vertical to the inserting direction, and the grounding fingers of the side wall contact to the periphery of the camera module, by which the electricity from the camera module is transmit to the housing 10. Finally, the shield element 7 is attached to a bottom surface of the housing 10 by sticking. Thus, the electricity of the camera module is transmitted to the printed circuit board by compressing the shield element.

In above embodiment, the shield element is attached to the bottom surface of the housing, while the shield element can be attached to the side wall of the housing according to the different requirements.

In the above description of the preferred embodiment, a shield element 7 is attached to bottom surface of the housing 10 or out surface of the side wall of the housing 10 according to the different requirements, therefore, when the electrical connector is assembled to the mobile phone, the shield element can be compressed between the housing and an inner wall formed on a chamber on the printed circuit board of the mobile phone for accommodating the electrical connector. Thus, the base wall and the side wall of the housing can be well contact with the inner wall of the chamber of the mobile phone and the electricity from the camera module can be transmitted to the printed circuit board and a grounding function has been well realized.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

a metallic housing integrally forming a base wall and side walls extending upwardly from four edges of the base wall commonly and at least a grounding finger formed on one of the side walls;

a plurality of spring fingers stamped on the base wall and extending upwardly from the base wall; and a shield element, which is compressive and conductive, attached to the base wall of the housing; wherein the shield element is attached to a bottom face of the base wall; where the shielded element is conductive foam; wherein the base wall and the side walls commonly define a receiving space, and wherein the spring fingers extend from the base wall to the receiving space; wherein the spring fingers are arranged in two rows; wherein the base wall defines a plurality of grooves corresponding to the spring fingers; wherein one of the side walls defines a window passing from top to bottom so as to provide a path for a flexible printed circuit board passing therethrough.

2. An electrical connector assembly comprising:

a metallic shell including a bottom wall and a plurality of side walls commonly defining a receiving space;

a camera module received in said receiving space;

a plurality of spring arms upwardly unitarily extending and stamped from the bottom wall; and a flexible printed circuit board (FPC) being sandwiched between the spring arms and an underside of the camera module; and a shield plate covering an undersurface of the bottom wall; wherein the side walls define a plurality of retention structure to hold the camera module in the receiving space; wherein said shield plate veil openings in said bottom wall, which are derived from the spring arms which are stamped out of the bottom wall; wherein one of the side walls defines a window passing from top to bottom so as to provide a path to allow said flexible printed circuit board to pass therethrough.

* * * * *